US005765250A

United States Patent [19]

Lee

[11] Patent Number: 5,765,250

[45] Date of Patent: Jun. 16, 1998

[54] FLOOR CLEANER WITH TILTABLE HANDLE AND FOUR WHEEL SUPPORT FOR STORAGE

[76] Inventor: Kyu H. Lee, 1633 W. 134th St., Gardena, Calif. 90249-2013

[21] Appl. No.: 833,937

[22] Filed: Apr. 10, 1997

[51] Int. Cl.[6] ..... A47L 11/283

[52] U.S. Cl. ..... 15/49.1; 15/50.1; 15/98; 451/353

[58] Field of Search ..... 15/49.1, 50.1, 15/98, 410; 451/350, 353

[56] References Cited

U.S. PATENT DOCUMENTS

| | | | |
|---|---|---|---|
| 2,949,619 | 8/1960 | Holt | 15/49.1 |
| 4,358,868 | 11/1982 | Cook, Jr. | 15/49.1 |
| 4,658,459 | 4/1987 | Wood | 15/49.1 |
| 4,742,652 | 5/1988 | Cannan et al. | 15/49.1 X |
| 4,756,042 | 7/1988 | Genovese et al. | 15/49.1 X |
| 4,845,798 | 7/1989 | Genovese | 15/98 |

FOREIGN PATENT DOCUMENTS

| | | | |
|---|---|---|---|
| 105014 | 12/1926 | Austria | 15/49.1 |
| 5-115400 | 5/1993 | Japan | 15/49.1 |

*Primary Examiner*—Mark Spisich
*Attorney, Agent, or Firm*—Willie Krawitz

[57] ABSTRACT

A floor cleaner device is described comprising a rolling support on which is mounted a tiltable handle that can be secured in various angular positions during use by means of a set of solenoid actuated locking pins which engage a set of bores defined on the handle frame. During use, the device is balanced between a first set of wheels and a rotatable cleaning element. A second set of wheels is maintained in an elevated position by the handles during use and out of contact with the floor surface which is being cleaned. To conserve space during storage and when not in immediate use, the device may be positioned in an upright position and stable manner by tilting the handle to a vertical position and engaging the actuated pins into the appropriate bores to effect upright positioning. This tilt configuration will lower the second set of wheels into contact with a floor surface, and balance the device between the two sets of wheels, and consequently the device will occupy less space.

1 Claim, 2 Drawing Sheets

FIG. 1
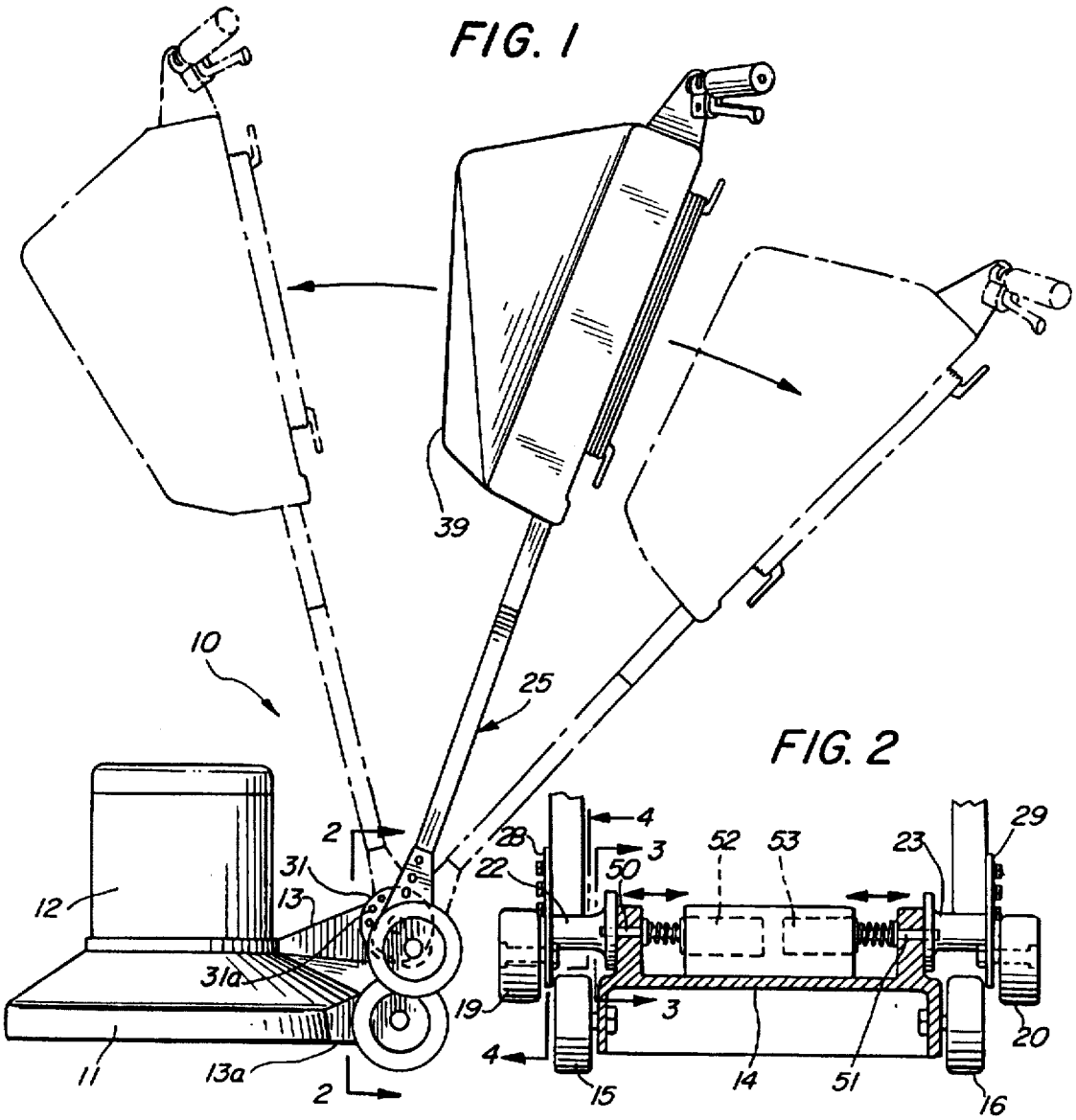
FIG. 2
FIG. 3
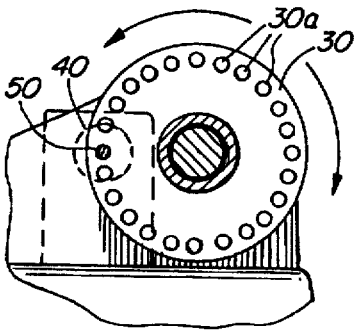
FIG. 4
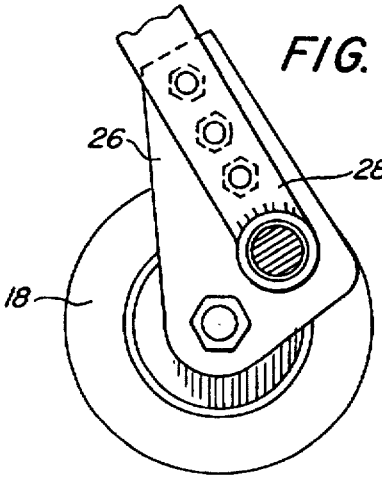

FLOOR CLEANER WITH TILTABLE HANDLE AND FOUR WHEEL SUPPORT FOR STORAGE

BACKGROUND OF THE INVENTION

This invention relates to a new and improved floor cleaning device, the handle of which can be tilted to suit a user's height during use and which can be stored or positioned in an upright and stable manner while occupying less floor space.

Floor cleaning devices generally tend to be unwieldy and somewhat cumbersome, and usually cannot be sized to fit individual requirements. Additionally, during storage these devices tend to take up too much space, and the same applies when the device is temporarily not being used.

Accordingly, a device is desired that can fit various individual size requirements and which requires less space either during storage, or when temporarily not in use. Also, a floor cleaning device is desired which can be quickly moved by rolling from one location to another without having to exert force on the cleaning element of the device.

THE INVENTION

According to the invention, there is provided a floor cleaning device having a base portion which houses a rotatable cleaning element and attached drive motor. Attached to the base portion is a frame element on which are mounted a first set of wheels which are in continuous contact with a floor surface and which counterbalance the base portion during use. A second set of wheels having extended wheel hubs is rotatable within the frame element and secured in position through sets of solenoid actuated, spring loaded pin and bore interlocks, and a handle frame is rotatably mounted at either end on a wheel hub. When it is desired to tilt the handle frame to a different position to accommodate a user's height or to a desired tilt position, the pins are retracted by solenoid actuation and removed from a particular set of bores, the handle frame is rotated to the desired position, and the pins are then actuated into the corresponding new bore position.

When it is desired to store the floor cleaning device, or to temporarily inactivate or easily move the device, the handle can be tilted to an appropriate position for selection of an appropriate bore and pin setting and effect an upright position of the handle, thereby lowering the second set of wheels.

BRIEF DESCRIPTION OF THE DRAWINGS

FIG. 1 is a side elevation view, partly in section of the floor cleaning device of this invention showing different tilt positions of the handle;

FIG. 2 is an end elevation view partly in section taken along lines 2—2 of FIG. 1;

FIG. 3 is a side elevation view of the insert bore portion of the device taken along lines 3—3 of FIG. 2;

FIG. 4 is an external side elevation view of the wheel attachment to the handle frame, and taken along lines 4—4 of FIG. 2;

DESCRIPTION OF THE PREFERRED EMBODIMENTS

Figure 5:
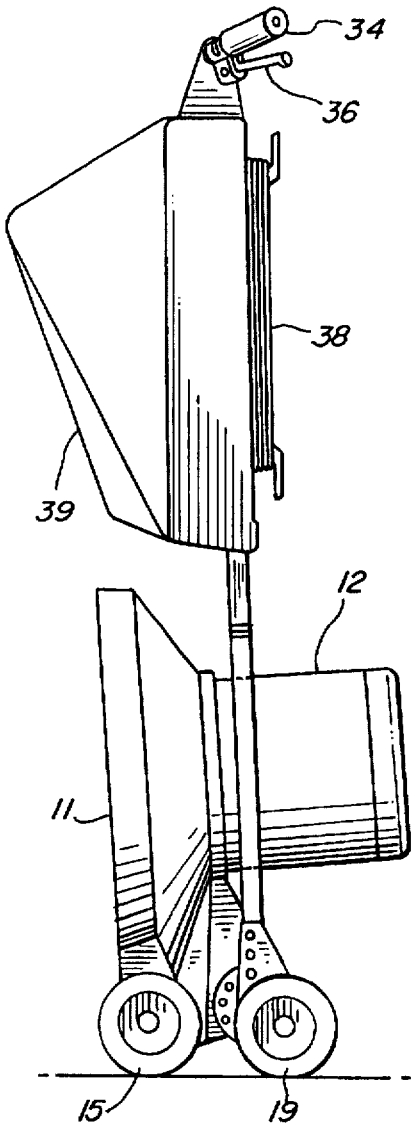
FIG. 5 is an external, side elevation view of the floor cleaning device in an upright position useful for storage, movement of the device, and the like; and, FIG. 6 is an external, end elevation view, partly in section, of the floor cleaning device in an upright position, similar to FIGS. 2 and 5.

The floor cleaning device 10 of this invention is shown in FIG. 1 and comprises a base portion 11 which encloses a typical brush or similar floor cleaning element, and an upper enclosure 12 mounted on top of the base portion and which encloses a motor for driving the brush; the cleaning brush and motor are standard components and hence are not shown. The base portion 11 forms extensions 13 to which is attached a frame element 14. A first set of wheels 15, 16 and a second set of wheels 19 and 20 are both journaled into the frame element, the second set of wheels defining corresponding hub portions 22, 23.

A handle 25 providing lower fork elements 26, 27 is rotatably mounted around the hub portions 22, 23 and each fork is bolted to the second set of wheels 19, 20 through plates 28 and 29. Pin locking plates 30, 31 are mounted on each fork element and provide a series of bores 30*a* and 31*a* which are circularly disposed on the periphery of the plate, as shown in FIGS. 1 and 3. The upper portion of the handle 25 extends from the fork portions into a central elongate handle 33 and upper guide handles 34, 35 to which are attached controls 36, 37 for applying fluid application and suction of used liquid from the floor. A power cord 38 is mounted on the central handle 33 and the power control and connection to the motor are not shown for the sake of simplicity. A container 39 attached to the handle contains washing liquid for applying to the floor and to receive used liquid; the floor cleaner is also useful to polish floors.

Pin loading plates 40, 41 are mounted on each side of the frame 14 and adjacent to the locking pin plates 30, 31 and a pair of spring loaded, solenoid actuated locking pins 50 and 51 are actuated by corresponding solenoids 52, 53. When actuated, the locking pins are driven into the bores 30*a* and 31*a* of the pin locking plates to lock the handle in a given tilt, as shown in dotted designation in FIG. 1.

The handle tilt is changed by actuating the solenoids and retracting the locking pins 50, 51 out of engagement with the bores 30*a* and 31*a*; this enables the handle to be rotated to a new desired position, and then relocked.

As shown in FIGS. 1 and 2, when the floor cleaning device 10 is used in a cleaning mode, the first set of wheels 15 and 16 are in contact with the floor and are counterbalanced by the base portion 11 with the cleaning components and motor to stabilize the cleaning device; in the cleaning mode, the second set of wheels 19 and 20 are elevated out of contact with the floor.

Figure 6:
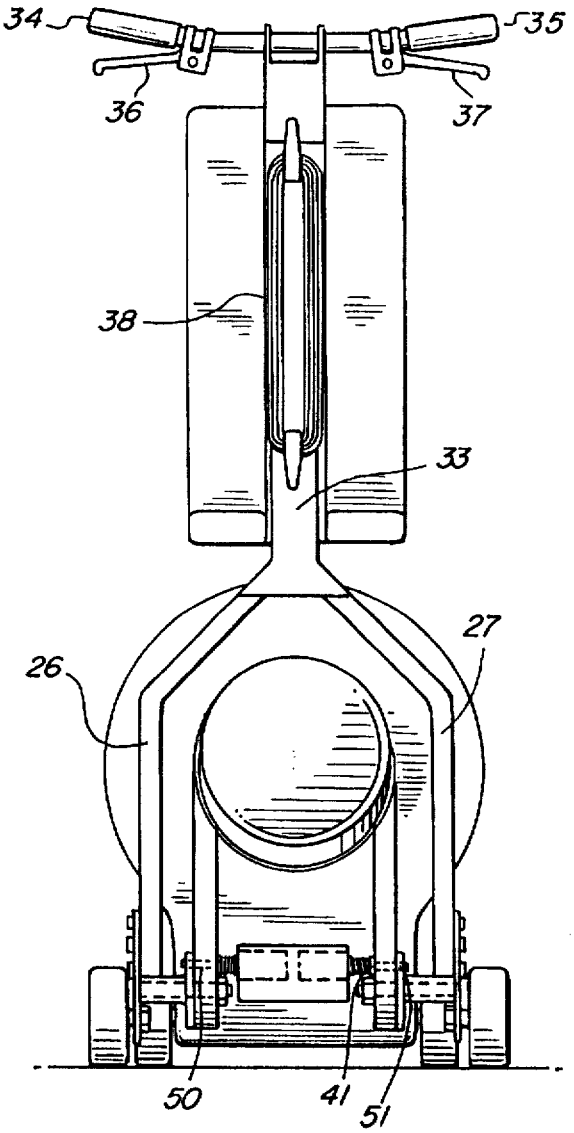

As shown in FIGS. 5 and 6, when it is desired to store the device for the night or for temporarily purposes such as between shifts or to rapidly move the device from one location without being encumbered by contact of the cleaning element with the floor, the second set of wheels are lowered and the cleaning device is configured in an upright position. This configuration is achieved by disengaging the locking pins as previously described, rotating the handle forward to enable engagement of the locking pins 50, and 51 into a specific bore alignment, and rotating the handle to an erect position. This will rotate the base portion 11 by 90° and into the position shown, so that both the first set of wheels 15 and 16 and the second set of wheels 19 and 20 are now in contact with the floor and will counterbalance the device for storage, movement, etc.

Hence, the device 10 of this invention provides ready storage and space saving while enabling efficient movement from one location to another, and also enables an operator more flexibility both in terms of the operator's size and posture, and in terms of device usage.

I claim:

1. The floor cleaning device, comprising:

a.) a base portion enclosing a rotatable cleaning element and drive motor components therefor;

b.) a frame element attached to the base;

c.) a first set of wheels mounted on the frame element and adapted for continuous contact with the floor, and which counterbalance the base portion and floor cleaning device during use;

d.) a second set of wheels with extended hubs rotatably mounted on the frame element, and secured in position through sets of solenoid actuated, spring loaded, pin and bore interlocks;

e.) a generally U-shaped handle frame providing fork elements, a fork element being rotatably mounted at each end of a corresponding wheel hub, and attached thereto;

f.) pin locking plates mounted on each side of the handle frame and providing a series of circularly disposed bores; and, g.) pin loading plates mounted on each side of the frame element and providing spring loaded, solenoid actuated locking pins disposed adjacent to the circularly disposed bores of the pin locking plates;

whereby, in the floor cleaning mode, the positioning of the locking pins with respect to the handle frame causes the first set of wheels and base portion to be in continuous contact with the floor, and the second set of wheels is maintained out of contact with the floor, and in the storage and moving mode, the locking pins are disengaged from the handle frame, the handle is rotated to elevate the base portion and components out of contact with the floor, the locking pins are re-engaged to lock the handle frame into an upright position, and the second set of wheels are lowered into contact with the floor, the first and second sets of wheels thereby counterbalancing the floor cleaning device.

* * * * *